US005659227A

United States Patent [19]

Ushiro et al.

[11] Patent Number: 5,659,227

[45] Date of Patent: Aug. 19, 1997

[54] FLUORESCENT LAMP CONTROLLER AND ORIGINAL-DOCUMENT EXPOSING APPARATUS A HAVING THE FLUORESCENT LAMP CONTOLLER

[75] Inventors: Takahiro Ushiro, Kawasaki; Kazuki Miyamoto; Naoyuki Ohki, both of Yokohama; Shinichi Takata, Kawasaki, all of Japan

[73] Assignee: Canon Kabushiki Kaisha, Tokyo, Japan

[21] Appl. No.: 494,786

[22] Filed: Jun. 26, 1995

[30] Foreign Application Priority Data

Jul. 7, 1994 [JP] Japan ..... 6-155981

[51] Int. Cl.[6] ..... H05B 37/02

[52] U.S. Cl. ..... 315/158; 315/159; 315/116; 315/360; 315/94

[58] Field of Search ..... 315/151, 115, 315/116, 158, 159, 176, 360, 94; 250/205; 355/204, 229

[56] References Cited

U.S. PATENT DOCUMENTS

| | | | |
|---|---|---|---|
| 4,378,515 | 3/1983 | Nakai et al. | 315/290 |
| 4,533,853 | 8/1985 | Hammond et al. | 315/117 |
| 4,533,854 | 8/1985 | Northrup | 315/117 |
| 4,797,598 | 1/1989 | Oikawa et al. | 315/85 |
| 5,095,329 | 3/1992 | Morikawa | 355/69 |

*Primary Examiner*—Robert Pascal
*Assistant Examiner*—Haissa Philogene
*Attorney, Agent, or Firm*—Fitzpatrick, Cella, Harper & Scinto

[57] ABSTRACT

A fluorescent lamp controller for an original-document exposing apparatus includes a detection circuit for detecting the quantity of light emitted by a fluorescent lamp, an actuator for applying between filaments of the fluorescent lamp a voltage having a duty that is determined in accordance with the quantity of light detected, and a preheating circuit for preheating each of the filaments of the fluorescent lamp by applying a preheating voltage. According to the present invention, the actuator applies, between the filaments of the fluorescent lamp, a voltage having a duty which is smaller than the full duty regardless of a result of the quantity of light detected in a predetermined period at a start of turning the fluorescent lamp on, and the preheating circuit applies the preheating voltage to each of the filaments of the fluorescent lamp simultaneously with the application of the turning on voltage.

14 Claims, 4 Drawing Sheets

FLUORESCENT LAMP CONTROLLER AND ORIGINAL-DOCUMENT EXPOSING APPARATUS A HAVING THE FLUORESCENT LAMP CONTOLLER

BACKGROUND OF THE INVENTION

1. Field of the Invention

The present invention relates to a fluorescent lamp controller that is used in a copying machine or a facsimile apparatus, and to an original-document exposing apparatus having the foregoing controller.

2. Related Background Art

A fluorescent lamp has been used in a copying machine and a facsimile apparatus to expose an original document to light. The facsimile apparatus in an apparatus of the foregoing type must be able to repeatedly turn on and off. Furthermore, the fluorescent lamp must be able to quickly and stably turn on with an appropriate quantity of light to which the original document is to be exposed. Therefore, preheating of the fluorescent lamp has been performed in general.

If voltage is, at the time of turning the fluorescent lamp on, applied between two filaments before the filaments are not heated satisfactorily, the fluorescent lamp cannot easily be turned on, and the fluorescent lamp will be damaged. Accordingly, no voltage is applied between the two filaments for a predetermined period at the time of turning the fluorescent lamp on, but each of the two filaments of the fluorescent lamp is applied with voltage to be previously heated. After each filament has been heated satisfactorily, voltage is applied between the two filaments in accordance with the detected quantity of light to turn on the fluorescent lamp.

Furthermore, duty control has been employed with which the turning-on duty of the voltage to be applied between the filaments is adjusted to approach an aimed quantity of light. During the period in which the turning-on duty is turned on, applying of the voltage to each of the filaments is inhibited to prevent the filaments being heated excessively due to the heat of the filaments generated by a lamp electric current flowing between the two filaments, thereby preventing further heating of the filaments. During the period in which the turning-on duty is turned off, each filament is applied with voltage to heat the filaments in order to prevent cooling of the filaments.

However, with the foregoing conventional technology, the detected light quantity before the fluorescent lamp is turned on is a quantity detected in a state where no light quantity is present. Therefore, the turning-on duty is made to be 100% to quickly turn on the fluorescent lamp until the fluorescent lamp emits light with an aimed light quantity. That is, the period, in which the duty is turned off, is not present. However, applying of preheating voltage to each of the filaments is inhibited in the period in which the turning-on duty is turned on. Since the lamp electric current does not pass in a large quantity between the filaments, the filaments are gradually cooled as the time passes. If the lamp electric current passes in a sufficient quantity before the filaments are cooled, the filaments can be heated satisfactorily. If a long time takes for the lamp electric current to pass, the filaments are cooled, and therefore the fluorescent lamp cannot easily be turned on with an appropriate light quantity. Even if the fluorescent lamp is turned on, the filaments will be damaged.

Therefore, the conventional apparatus for exposing an original document to light encounters a problem in that exposure of an original document to light with an appropriate light quantity cannot quickly be started, and another problem in that exposure of an original document to light with an appropriate quantity cannot stably be performed.

SUMMARY OF THE INVENTION

Accordingly, the present invention is directed to overcome the foregoing problems, and an object of the present invention is to provide an apparatus for operating a fluorescent lamp that is capable of quickly and stably turn a fluorescent lamp on with an appropriate light quantity.

Another object of the present invention is to provide an original-document exposing apparatus for a copying machine or a facsimile apparatus that is capable of quickly and stably exposing an original document to light with an appropriate light quantity.

According to one aspect of the present invention, there is provided an apparatus for operating a fluorescent lamp which includes a detector for detecting the quantity of light emitted by a fluorescent lamp, an actuator for applying, between filaments of the fluorescent lamp, turning-on voltage having a duty that is determined in accordance with the light quantity detected by the detection means, and a preheating device for applying preheating voltage to each of the filaments of the fluorescent lamp.

According to this invention, the turning-on means applies, between the filaments of the fluorescent lamp, turning-on voltage having a duty lighter than the full duty regardless of a result of detection of the quantity of light performed by the detector in a predetermined period at start of turning the fluorescent lamp on, and the preheating device applies the preheating voltage to each of the filaments of the fluorescent lamp simultaneously with applying of the turning-on voltage.

Other and further objects, features and advantages of the invention will be evident from the following detailed description of the preferred embodiments in conjunction with the attached drawings.

BRIEF DESCRIPTION OF THE DRAWINGS

FIG. 2 is a block diagram showing a controller for turning a fluorescent lamp on;

DESCRIPTION OF THE PREFERRED EMBODIMENTS

Figure 1:
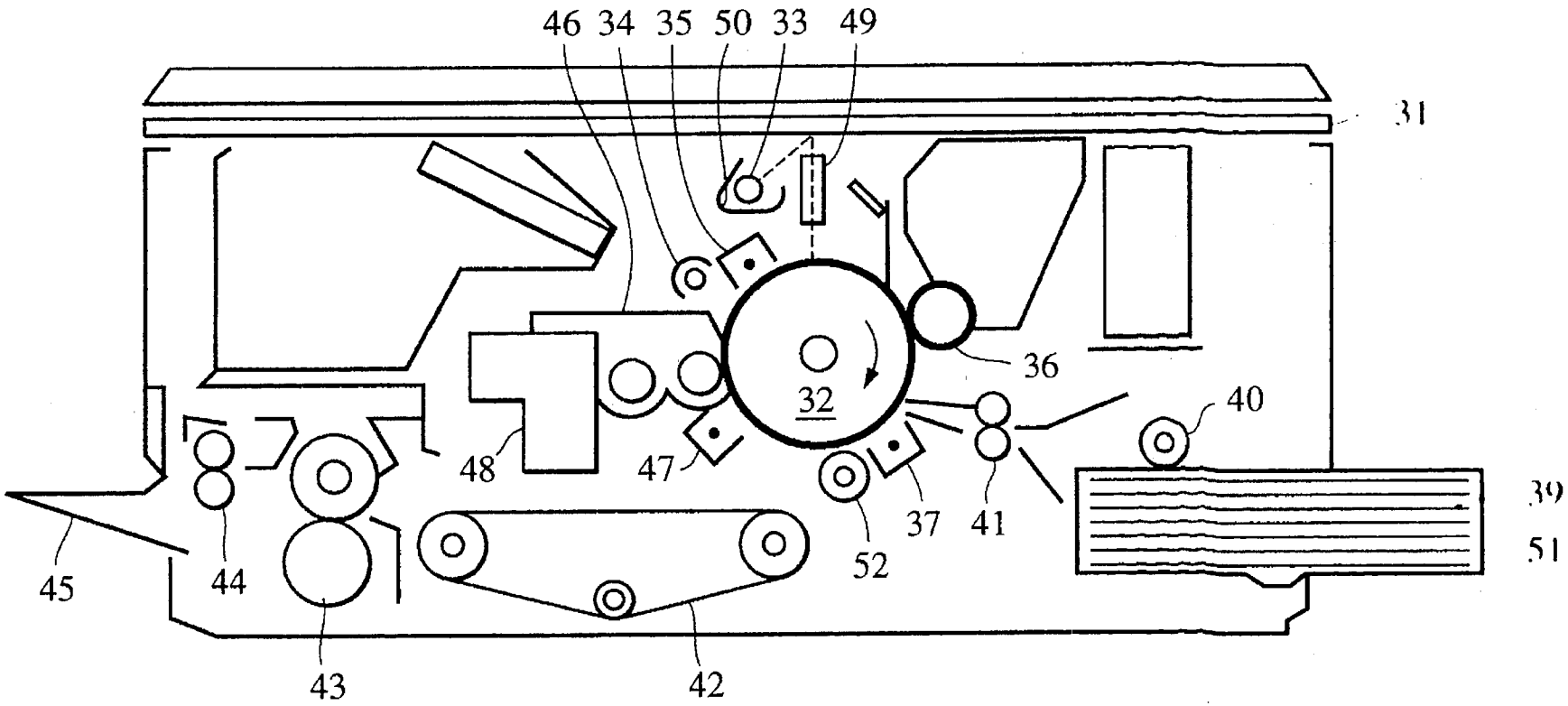
FIG. 1 is a structural view of a copying machine to which the present invention is applied.

Referring to the drawings, an embodiment of the present invention will now be described.

FIG. 1 is a structural view of a copying machine to which the present invention is applied. Referring to FIG. 1, reference numeral 31 represents a platen on which an original document is placed, the platen 31 being reciprocated by a drive mechanism (not shown). Reference numeral 32 represents a rotative drum comprising a photosensitive layer disposed around a cylindrical aluminum conductor base, the photosensitive layer being made of a seamless organic semiconductor (OPC). Reference numeral 33 represents a fluorescent lamp for exposing, to light, an image of the original document on the platen 31. Reference numeral 34 represents a pre-exposing lamp, and 35 represents a primary charger for previously and negatively charging the surface of the photosensitive member. Reference numeral 36 represents a developing unit for developing an electrostatic latent image formed on the drum 32. Reference numeral 37 represents a transfer charger for transferring a developed image on the drum 32 to transfer paper 39. Reference numeral 51 represents a cassette accommodating a multiplicity of the transfer paper, the cassette 51 being made detachable with respect to the body of the copying machine. Reference numeral 40 represents a roller for sequentially supplying the transfer paper 39 from the cassette 51. Reference numeral 41 represents a register roller for aligning the leading end of the transfer paper 39 and the developed image on the drum 32 to each other. Reference numeral 52 represents a separation roller for separating the transfer paper 39 from the drum 32. Reference numeral 42 represents a belt for conveying the transfer paper 39, on which the image has been transferred. Reference numeral 43 represents a fixing roller for fixing the image onto the transfer paper 39. Reference numeral 44 represents a discharge roller for discharging, to a tray 45, the transfer paper 39. Reference numeral 46 represents a cleaner for removing toner left on the drum 32 from which the image has been transferred. Reference numeral 47 represents a pre-cleaning destaticizer for making easy the removal of the retained toner. Reference numeral 48 represents a container for receiving the toner removed from the surface of the drum 32. Reference numeral 49 represents a converging-type rod lens array for imaging, onto the surface of the drum 32, light emitted from the fluorescent lamp 33 and reflected by the original document. Reference numeral 50 represents a light detector, such as a photodiode, for detecting the quantity of light of the fluorescent lamp 33.

The operation will now be described. When a copying switch (not shown) is switched on, the fluorescent lamp 33 is turned on, and as well the drum 32 is rotated. After the drum 32 has been rotated substantially one time, the platen 31 starts moving forwards so that slit exposure of the original document on the platen 31 is started. A reflected image of the original document realized by light emitted from the fluorescent lamp 33 is, through the rod lens array 49, slit-exposed onto the drum 32. The front portion of the photosensitive member of the drum 32 is exposed to light by the pre-exposing light 34, followed by being charged by the primary charger 35. When the charged surface of the drum 32 has reached the exposing position, negative charges are removed by the optical image. As a result, a negative electrostatic latent image is formed on the surface of the drum 32. The latent image is supplied with toner, that has been positively charged by the developer 36, which uses a developing bias composed of superimposed AC bias and DC bias, so that the latent image is converted into a visual image. The visual image is, by the transfer charger 37, transferred to the transfer paper 39 in a transfer region in the copying machine. One transfer paper 39 has been separated and conveyed from the cassette 51 at the timing of the operation of the paper supply roller 40, and then the transfer paper 39 is caused to pass through the transfer region at the same speed as the peripheral speed of the drum 32. The transfer paper 39, onto which the image has been transferred, is separated from the drum 32 by the roller 52, followed by being conveyed to the fixing roller 43 so that the image is fixed. Then, the transfer paper 39 is discharged to the tray 45 by the roller 44. The surface of the drum 32, from which the image has been transferred, is destaticized by the pre-cleaning destaticizer 47, followed by being cleaned by the cleaner 46.

In a case where the same original document is consecutively copied, the reciprocating operation of the platen 31 is repeated by the number set by using a ten key pad in the operation portion of the copying machine.

The control of the operation of the fluorescent lamp in the copying machine shown in FIG. 1 will now be described.

Figure 2:
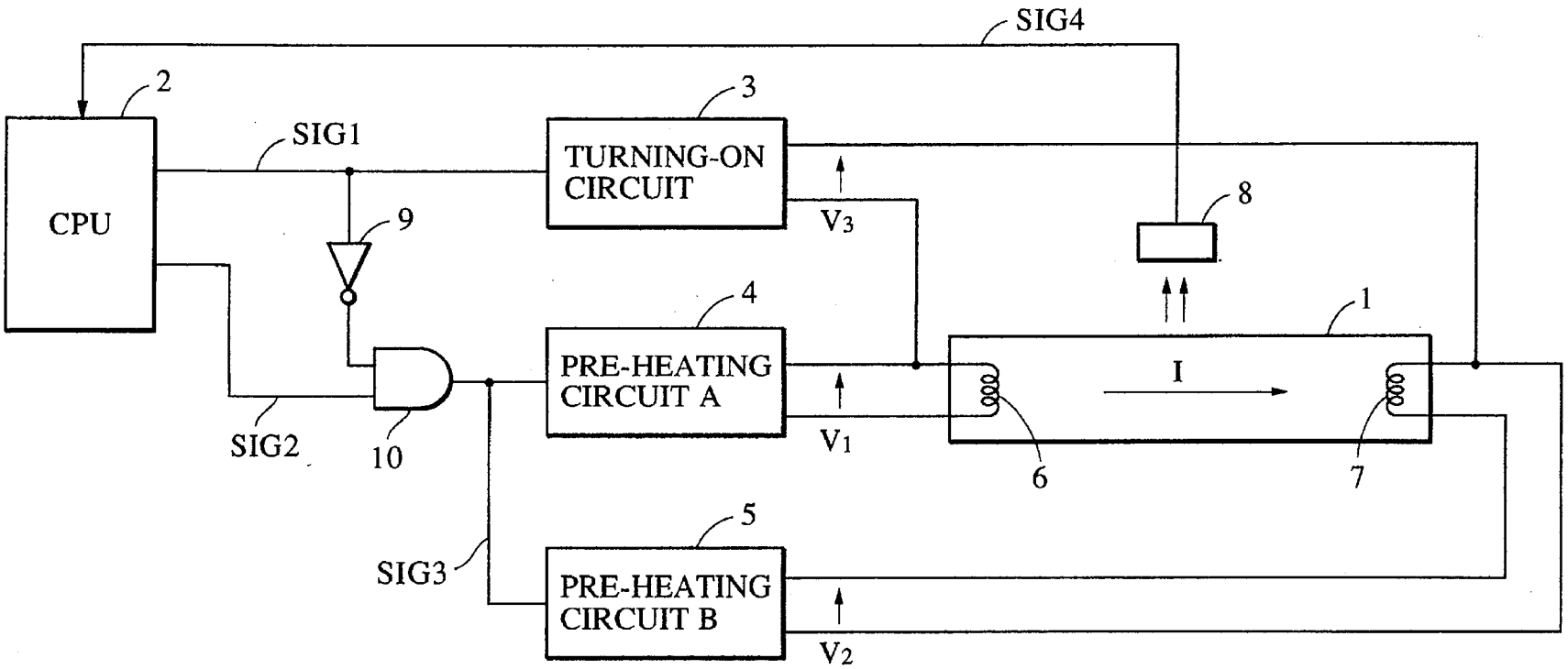

FIG. 2 is a block diagram showing the structure of an apparatus for turning the fluorescent lamp on. Referring to FIG. 2, reference numeral 1 represents a fluorescent lamp, 2 represents a microcomputer (CPU) which includes a PWM circuit, 3 represents a turning-on circuit, 4 represents a preheating circuit A, 5 represents a preheating circuit B, 6 and 7 represent filaments of the fluorescent lamp 1, and 8 represents a light quantity detection circuit. Note that the fluorescent lamp 1 and the light quantity detection circuit 8 shown in FIG. 2 correspond to the fluorescent lamp 33 and the light quantity detection circuit 50 shown in FIG. 1.

Figure 4:
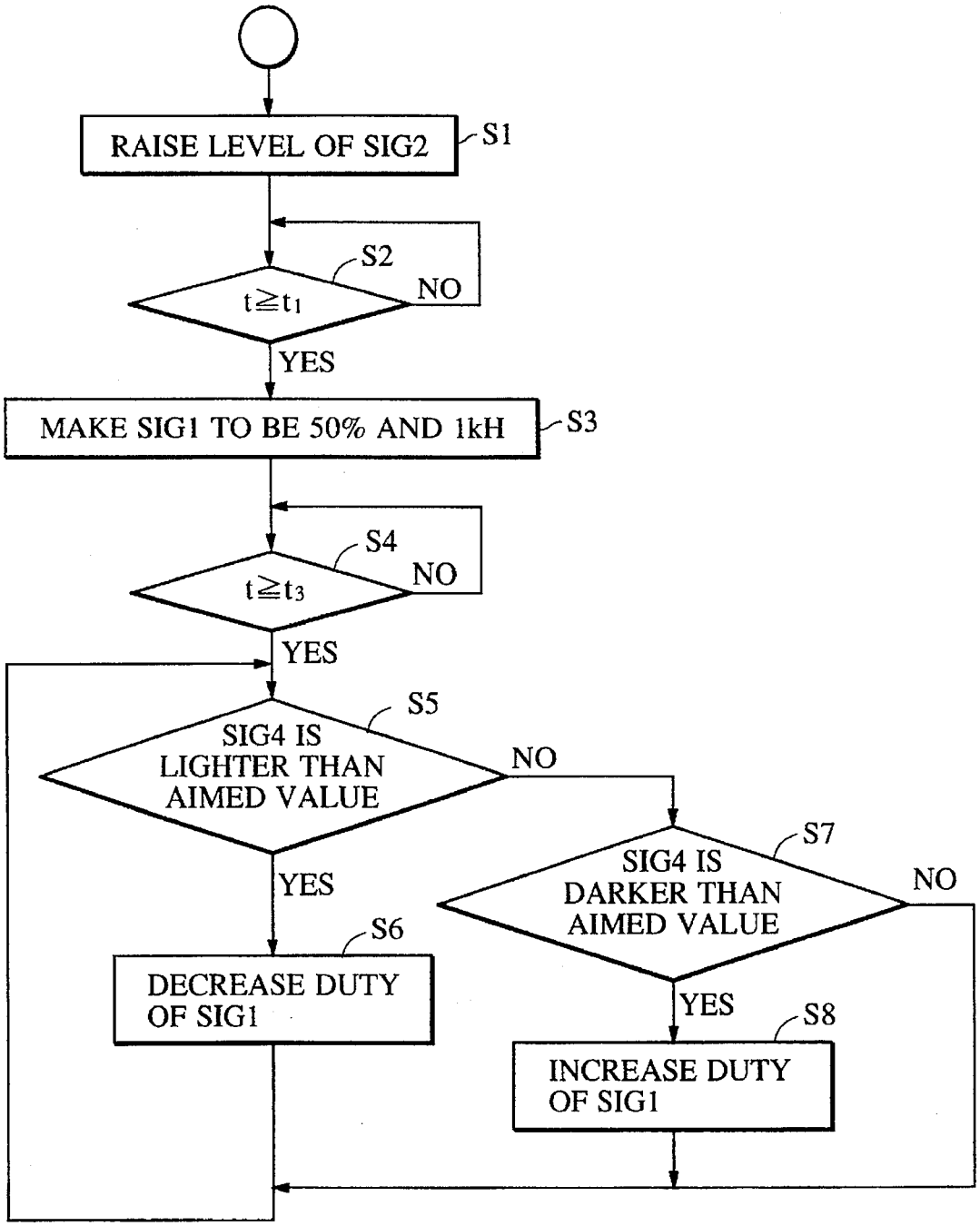
FIG. 4 is a flow chart showing the procedure of control performed by a microcomputer.

CPU 2 controls the operation of the fluorescent lamp 1 in accordance with a control procedure arranged as shown in a flow chart of FIG. 4.

Figure 3:
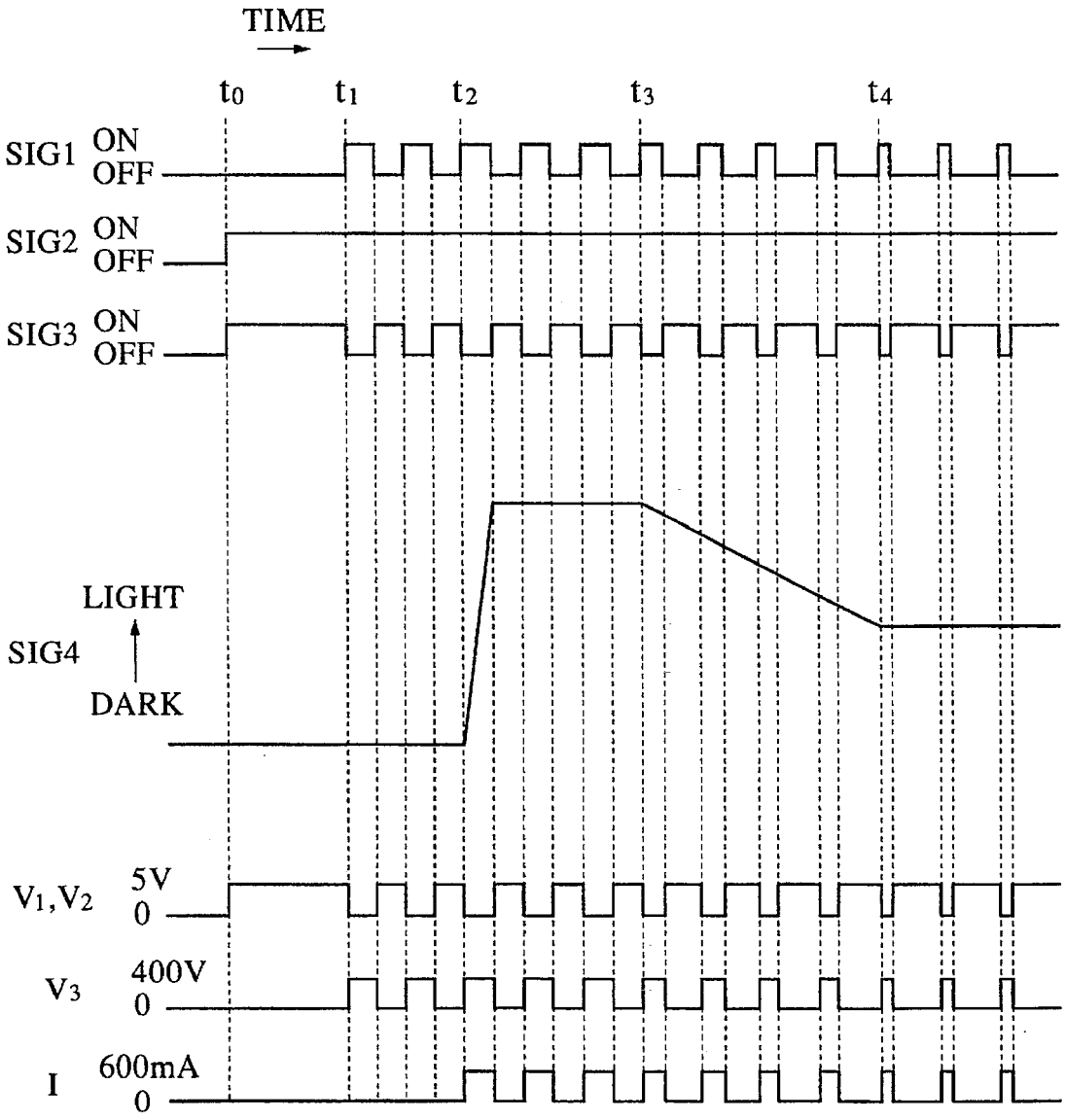
FIG. 3 is a timing chart of signals for use in the structure shown in FIG. 1.

The control to be performed from start of the operation of the fluorescent lamp 1 to a moment the quantity of light is stabilized will now be described with reference to a signal timing chart shown in FIG. 3 and the flow chart shown in FIG. 4.

In a period before time t0, the fluorescent lamp 1 is turned off.

CPU 2 transmits a high level preheating signal SIG2 from time t0 (S1). Since the level of signal SIG1 is low at this time, an AND circuit 10 transmits high level signal SIG3 so that the preheating circuits A4 and B5 are operated. Thus, the preheating circuits A4 and B5 transmit voltage signals V1 and V2 to heat the filaments 6 and 7 of the fluorescent lamp 1.

Then, lapse of time t1 is waited for (S2), and then CPU 2 transmits turning-on signal SIG1 representing a fixed frequency of, for example 1 kHz and a fixed duty ratio of 50%, in a period from time t1 to time t3 (S3). As a result, the turning-on circuit 3 is operated to transmit output V3, the voltage of which is not higher than 400 V. Note that the output V3 is so controlled as to be 400 V or lower and to cause a constant electric current 600 mA to flow. Although five cycles of the turning-on signals SIG1 to be transmitted in the period from time t1 to t3 are illustrated in FIG. 3, the signals SIG1 for tens of cycles, for example, fifty cycles, are repeatedly transmitted in actual. Note that the duty of the turning-on signal SIG1 in the period from time t1 to time t3 is not limited to 50%, but an appropriate duty is selected depending upon the characteristic of the fluorescent lamp and the environment for use. However, the duty must be less than 100%.

Since the signal SIG3 is made to be low regardless of the signal SIG2 by an inversion circuit 9 and the AND circuit 10 when the turning-on signal SIG1 is high, voltage signals V1 and V2 for respectively heating the filaments 6 and 7 are not transmitted from the preheating circuits A4 and B5. However, since the signal SIG1 is set to the duty of 50% in the period from time t1 to time t3, 50% of the voltage signals V1 and V2 are, as shown in FIG. 3, transmitted even in the period from time t1 to time t3 so that the filaments 6 and 7 are heated.

After the turning-on signals SIG1 for certain cycles have been transmitted, an electric current I starts flowing between the filaments 6 and 7. The time at which flowing starts is time t2 shown in FIG. 3.

Lapse of time t3 is waited for (S4). After time t3 has elapsed, the microcomputer 2 discriminates light quantity signal SIG4 from the light quantity detection circuit 8 to control the duty of the signal SIG1 to make the light quantity of the fluorescent lamp 1 to be an aimed quantity (S5 to S8). That is, if the fluorescent lamp 1 is lighter than the aimed light quantity (S5), the duty of the turning-on signal SIG1 is adjusted to a low level (S6). If the fluorescent lamp 1 is darker than the aimed light quantity (S7), the duty is raised (S8). At time t4, the aimed light quantity is realized.

The time t3, at which the light quantity is adjusted by the microcomputer 2 such that the duty is adjusted in response to the light quantity detection signal SIG4 from the light quantity detection circuit 8, is a certain time after the electric current has started flowing between the filaments 6 and 7 of the fluorescent lamp 1. The time t3 is a value previously set in accordance with a measured value or experiment value at the time of designing the circuit for turning the fluorescent lamp on.

The signal SIG1 to be supplied from CPU 2 to the turning-on circuit 3 is supplied to the AND circuit 10 through the inversion circuit 9 to gate the signal SIG2 from CPU 2. Therefore, the signal SIG3 is supplied to the preheating circuits A4 and B5 in the period, in which the signal SIG1 is turned off, so that the filaments 6 and 7 are previously heated.

That is, when the duty of the turning-on signal SIG1 is heavy, signal SIG3 having a light duty is supplied to the preheating circuits A4 and B5 so that preheating with small electric power is performed. If the duty of the signal SIG1 is light, signal SIG3 having a heavy duty is supplied to the preheating circuits A4 and B5 so that preheating with large electric power is performed.

As described above, voltage can be applied between the filaments while preheating each of the filaments until the lamp electric current starts flowing between the filaments and thus the fluorescent lamp is turned on. As a result, undesirable cooling of the filaments occurring at the initial stage of the operation of the fluorescent lamp can be prevented. Thus, the fluorescent lamp can be quickly turned on with an appropriate light quantity, and the filaments can be prevented from damage.

Therefore, the copying machine shown in FIG. 1 having the controller for turning the fluorescent lamp on as shown in FIG. 2 is able to quickly start exposing an original document to light with an appropriate light quantity. Thus, the copying efficiency can be improved, and the damage of the fluorescent lamp for exposing an original document to light can be protected from damage. As a result, an original document can stably be exposed to light with an appropriate quantity.

Although the description has been performed about the exposure of an original document to be performed in a copying machine, the apparatus for turning on a fluorescent lamp shown in FIG. 2 may, of course, be applied as a controller for turning on a fluorescent lamp for an original-document reading portion of a facsimile apparatus or an electronic file apparatus. Furthermore, the present invention is not limited to the control of the operation of a fluorescent lamp for exposing an original document to light, but it may be applied to a variety of apparatuses of a type having a fluorescent lamp.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. An apparatus for controlling an operation of a fluorescent lamp having plural filaments, comprising:

detection means for detecting a quantity of light emitted by the fluorescent lamp;

turning-on means for applying a turning-on voltage between filaments of the fluorescent lamp, the turning-on voltage having a duty ratio that is determined in accordance with the quantity of light detected by said detection means; and preheating means for applying a preheating voltage to each of said filaments of said fluorescent lamp;

wherein the turning-on means applies a predetermined voltage having a duty ratio which is smaller than a full duty ratio as the turning-on voltage for a predetermined period of time when said fluorescent lamp is turned on, the predetermined period of time being independent of the quantity of light detected by the detection means; and wherein said preheating means applies the preheating voltage to each of said filaments of said fluorescent lamp at substantially a same time as the predetermined voltage is applied as the turning-on voltage.

2. An apparatus according to claim 1, wherein the preheating voltage applied by the preheating means has a duty ratio that corresponds to the duty ratio of the turning-on voltage applied by said turning-on means.

3. An apparatus according to claim 1, wherein the turning-on voltage applied by the turning-on means has a duty ratio that is determined in accordance with the quantity of light detected by said detection means after said predetermined period of time has passed.

4. An apparatus according to claim 1, wherein said fluorescent lamp is a source of light which exposes an original document.

5. An original-document exposing apparatus comprising:

a fluorescent lamp for exposing an original document to light, the fluorescent lamp comprising plural filaments;

detection means for detecting a quantity of light emitted by said fluorescent lamp;

turning-on means for applying a turning-on voltage between filaments of the fluorescent lamp, the turning-on voltage having a duty ratio that is determined in accordance with the quantity of light detected by said detection means; and preheating means for applying a preheating voltage to each of said filaments of said fluorescent lamp;

wherein the turning-on means applies a predetermined voltage having a duty ratio which is smaller than a full duty ratio as the turning-on voltage for a predetermined period of time when said fluorescent lamp is turned on, the predetermined period of time being independent of the quantity of light detected by the detection means; and wherein said preheating means applies the preheating voltage to each of said filaments of said fluorescent lamp at substantially a same time as the predetermined voltage is applied as the turning-on voltage.

6. An original-document exposing apparatus according to claim 5, wherein the preheating voltage applied by said preheating means has a duty ratio which corresponds to the duty ratio of the turning-on voltage applied by said turning-on means.

7. An original-document exposing apparatus according to claim 5, wherein the turning-on voltage applied by the turning-on means has a duty ratio which is determined in accordance with the quantity of light detected by said detection means after said predetermined period of time has passed.

8. A method for controlling an operation of a fluorescent lamp having plural filaments, the method comprising:

a detecting step of detecting a quantity of light emitted by the fluorescent lamp;

a first applying step of applying a turning-on voltage between filaments of the fluorescent lamp, the turning-on voltage having a duty ratio that is determined in accordance with the quantity of light detected in the detecting step; and a second applying step of applying a preheating voltage to each of the filaments of the fluorescent lamp;

wherein a predetermined voltage having a duty ratio which is smaller than a full duty ratio is applied as the turning-on voltage for a predetermined period of time when the fluorescent lamp is turned on, the predetermined period of time being independent of the quantity of light detected in the detecting step; and wherein the preheating voltage is applied to each of the filaments of the fluorescent lamp at substantially a same time as the predetermined voltage is applied as the turning-on voltage.

9. A method according to claim 8, wherein the preheating voltage has a duty ratio that corresponds to the duty ratio of the turning-on voltage.

10. A method according to claim 8, wherein the turning-on voltage has a duty ratio that is determined in accordance with the quantity of light detected in the detecting step after the predetermined period of time has passed.

11. A method according to claim 8, wherein the fluorescent lamp is a source of light which exposes an original document.

12. An original-document exposing method comprising:

an exposing step of exposing an original document to light with a fluorescent lamp comprising plural filaments;

a detecting step of detecting a quantity of light emitted by the fluorescent lamp;

a first applying step of applying a turning-on voltage between filaments of the fluorescent lamp, the turning-on voltage having a duty ratio that is determined in accordance with the quantity of light detected in the detecting step; and a second applying step of applying a preheating voltage to each of the filaments of the fluorescent lamp;

wherein a predetermined voltage having a duty ratio which is smaller than a full duty ratio is applied as the turning-on voltage for a predetermined period of time when the fluorescent lamp is turned on, the predetermined period of time being independent of the quantity of light detected in the detecting step; and wherein the preheating voltage is applied to each of the filaments of the fluorescent lamp at substantially a same time as the predetermined voltage is applied as the turning-on voltage.

13. A method according to claim 12, wherein the preheating voltage has a duty ratio which corresponds to the duty ratio of the turning-on voltage.

14. A method according to claim 12, wherein the turning-on voltage has a duty ratio which is determined in accordance with the quantity of light detected in the detecting step after the predetermined period of time has passed.

* * * * *